United States Patent [19]

Forrest

[11] 4,398,482

[45] Aug. 16, 1983

[54] STITCH LENGTH STOPS FOR INDUSTRIAL SEWING MACHINE

[75] Inventor: David Forrest, Jamesburg, N.J.

[73] Assignee: The Singer Company, Stamford, Conn.

[21] Appl. No.: 304,740

[22] Filed: Sep. 23, 1981

[51] Int. Cl.[3] ..... D05B 27/22

[52] U.S. Cl. ..... 112/316; 74/526

[58] Field of Search ..... 112/316, 315, 261, 158 F, 112/158 B; 74/526

[56] References Cited

U.S. PATENT DOCUMENTS

| | | | |
|---|---|---|---|
| 484,360 | 10/1892 | Gawley | 74/526 |
| 2,557,992 | 6/1951 | Nilles | 112/316 |
| 2,715,885 | 8/1955 | Crowley | 74/526 |
| 2,794,408 | 6/1957 | Parry . | |
| 2,970,556 | 2/1961 | Johnson . | |
| 3,011,462 | 12/1961 | Ritter et al. . | |
| 3,202,121 | 8/1965 | Orth et al. . | |
| 3,638,593 | 2/1972 | Vollmar et al. | 112/316 |

FOREIGN PATENT DOCUMENTS

| | | | |
|---|---|---|---|
| 464686 | 4/1937 | United Kingdom | 74/526 |

*Primary Examiner*—Werner H. Schroeder
*Assistant Examiner*—Andrew M. Falik
*Attorney, Agent, or Firm*—Edward P. Schmidt; Robert E. Smith; Edward L. Bell

[57] ABSTRACT

Stitch length stops for an industrial sewing machine which is implemented by a stop member having a slot therethrough and a finger projecting therefrom, which slot is clamped behind a sheet metal bracket that may be affixed to a sewing machine frame. The sheet metal bracket is fashioned with an aperture through which a screw may extend through the slot of the stop member and into a bracket having a threaded aperture so that the stop member may be compressed between the bracket and sheet metal member. The sheet metal member may be implemented by a belt guard.

1 Claim, 3 Drawing Figures

STITCH LENGTH STOPS FOR INDUSTRIAL SEWING MACHINE

DESCRIPTION

BACKGROUND OF THE INVENTION

1. Field of the Invention

This invention is in the field of sewing machines; more particularly, it is concerned with a means for readily adding stitch length stops to an industrial sewing machine.

2. DESCRIPTION OF THE PRIOR ART

In the prior art, it is quite common to provide for stitch length adjustment mechanisms which may be varied to accommodate the particular needs of the work material being stitched upon. There are even provided stitch length adjusting mechanisms having built in stops for a desired forward stitch or rearward stitch. Such mechanisms are shown in the U.S. Pat. Nos. 3,011,462 of Ritter et al and 2,794,408 of Parry. These devices, though effective, contribute substantially to the cost of the sewing machine.

In certain applications, where a specific stitch length is required, it may be considered objectionable to have a capability for readily varying the stitch length. In this event, it would be more desirable that provisions be made to insure that adjustments may only be made by authorized service personnel. Further, there are many industrial sewing machines already in the field which have no provision for stops at all.

What is required is a means of readily and cheaply implementing stops readily adjustable only by service personnel for sewing machines in the field as well as those presently being built.

SUMMARY OF THE INVENTION

The above requirement is achieved in an industrial sewing machine in which the adjustable stops are included as part of a belt guard for the sewing machine. The belt guard encircles the hand wheel and extends down both sides of the sewing machine to prevent entanglement of the operator's appendages or clothing, or of other objects, with the belt driving the sewing machine. Provision is made for attaching the belt guard to the sewing machine frame for support thereof. The lower edge of the belt guard adjacent the stitch length regulating lever is slotted to accommodate the lever and is fashioned with two or more vertically spaced apertures for accomodating the passage of fastening screws therethrough which may be tightened by special tools not normally available to a sewing machine operator. The screws extend through slots in stops which are seated against the belt guard on the inside thereof. A bracket is positioned behind the stops, the bracket being fashioned with threaded apertures to receive the screws so that a selected position of the stops may be retained by compressing the same between the belt guard and the bracket. The stops are formed with elongated fingers which extend transversely of the sewing machine standard above and below the stitch length regulating lever. These fingers serve to limit the upper and lower extent of movement permitted to the stitch length regulating lever and their position may be adjusted within the extent of the slots in the stops which fit about the screws. A belt guard equipped as described may be supplied for use in existing machines in the field not having such a stop capability, or may be supplied on new machines. A belt guard design and stop design may be provided to accommodate for a wide varieity of sewing machines and stitch length regulating lever configurations.

DESCRIPTION OF THE DRAWINGS

Other objects and advantages of this invention will best be understood upon reading the following detailed description of the invention together with the accompanying drawings, in which:

Referring now to FIG. 1, there is shown a sewing machine 10 having a frame including a bed 12 supporting thereon a standard 14, which standard supports a bracket arm 16 in overhanging relationship to the bed, the bracket arm terminating in a head 18. Within the head 18 there is supported a presser bar 20 terminating in a presser foot 21 and a needle bar 22 terminating in a sewing needle 23.

Figure 1:
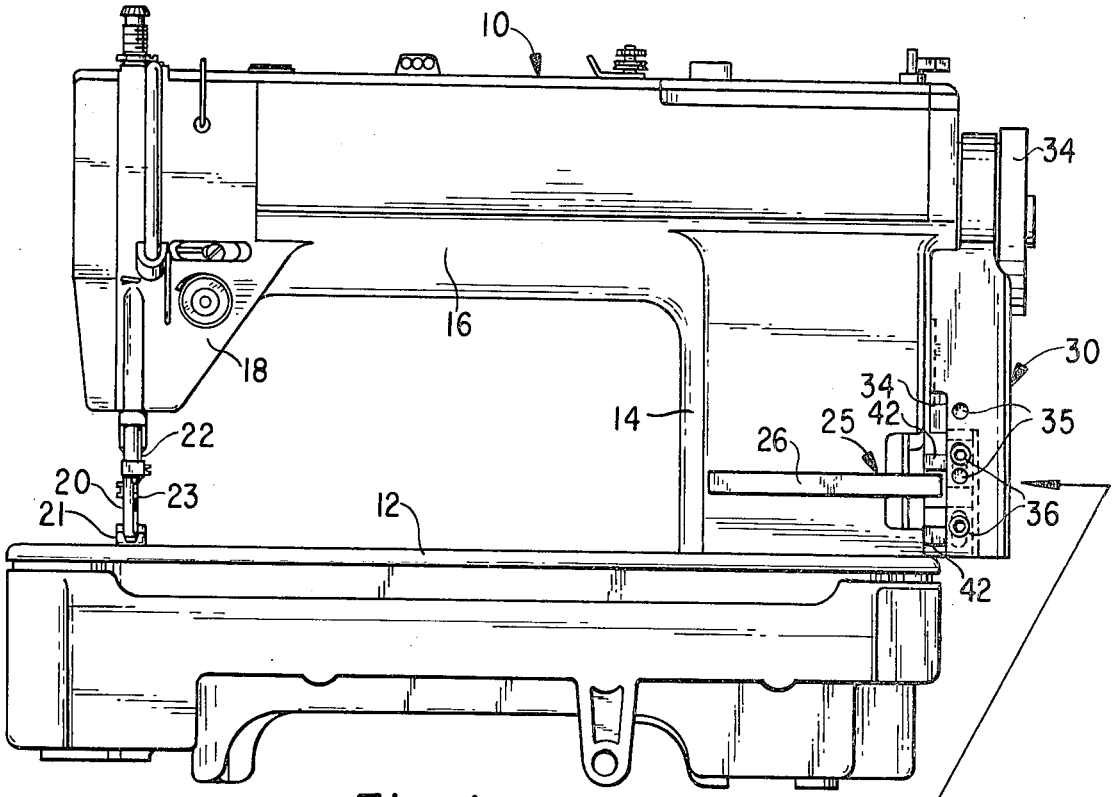
FIG. 1 is a front elevational view of a sewing machine incorporating the stitch length regulating lever stops on a sewing machine in accordance with the present invention.

Within the bed 12 there is supported a feed system which may be one of many feed systems well known in the sewing machine art. For a typical feed system, the reader is referred to the U.S. Pat. No. 4,095,546 which issued on June 20, 1978 to the Assignee of the instant invention, and is hereby incorporated by reference herein. In that patent there is disclosed a feed adjusting means which extends through the bed of the sewing machine so that the necessity for tilting the sewing machine to make that adjustment may be avoided. The feed system may be adjusted to implement reverse feed by means of a stitch length regulating lever 25 having a stitch length regulating lever arm 26 which extends laterally in front of the standard 14. The stitch length regulating lever arm 26 is disclosed in the drawings and in the patent is of a variety which is spring biased to the maximum position in forward feed to which the feed system has been adjusted. Depression of the stitch length regulating lever arm 26 to its maximum extent will initiate reverse stitching.

Figure 2:
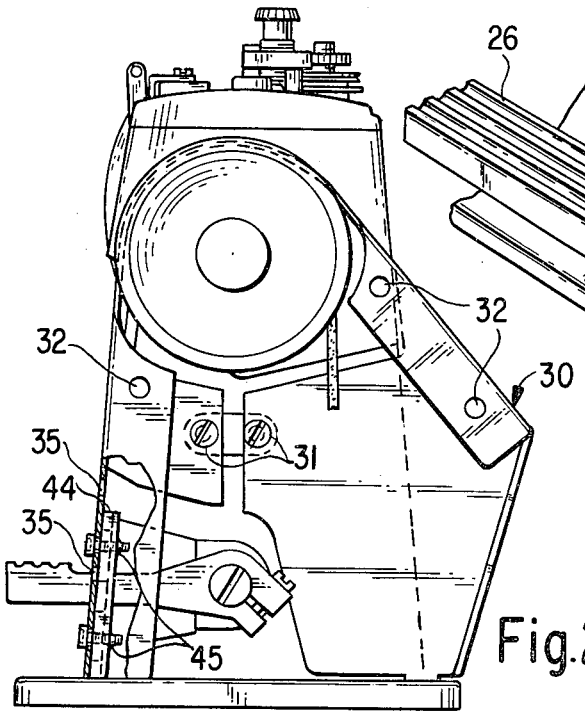
FIG. 2 is a side elevational view of the sewing machine shown in FIG. 1; and, FIG. 3 is a prospective view of a portion of the sewing machine shown in FIG. 1, and the belt guard attached thereto partially broken away to indicate the construction of the stops and attachment thereto.

Many industrial sewing machines are provided with belt guards designed to protect a sewing operator from the drive belt extending from a motor (not shown) supported beneath a work table (not shown) and extending therethrough to a pulley usually integral with the sewing machine handwheel. Thus, a belt guard 30 is provided which is fixed to the sewing machine standard 14 by screws 31 (see FIG. 2). The belt guard 30 extends about a pulley groove (not shown) in a handwheel 34 of the sewing machine 10. Not shown is a cover plate adapted to be attached to the belt guard 30 at apertures 32 to insure protection for a sewing machine operator. The belt guard 30 is fashioned with a cutout 34 to provide a passage way for the stitch length regulating lever 25. Adjacent the cutout, the belt guard 30 is provided with apertures 35, two of which are visible, the other of which apertures receive two screws 36.

Figure 3:
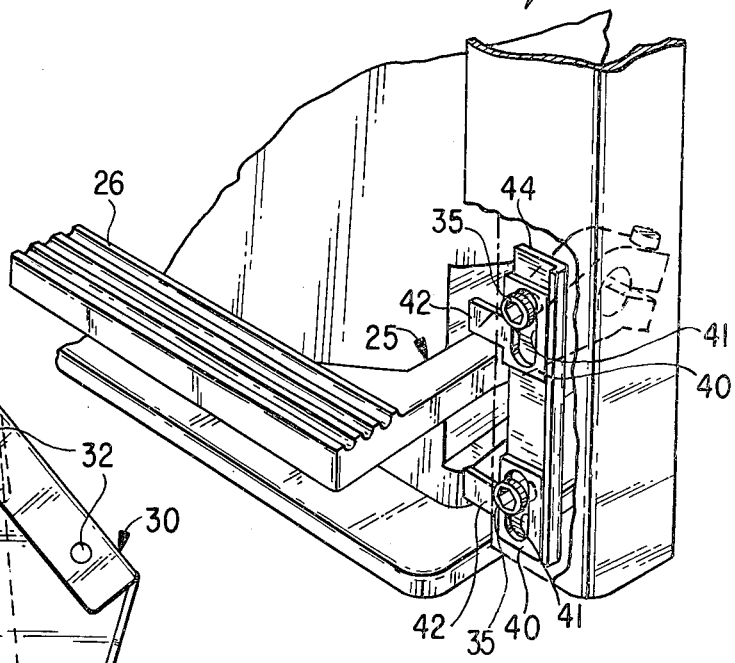

Referring to FIG. 3, a portion of the belt guard 30 is broken away to reveal the construction behind the belt guard. Visible are the screws 36 which extend through vertical slots 41 in upper and lower stops 40. The upper and lower stops 40 are formed with stop fingers 42 which extend out laterally beyond the stops above and below the stitch length regulating lever 25. A bracket 44 is positioned behind the stops 40 and extends thereabout to maintain the stops in an aligned condition with the stop fingers 42 extending laterally therefrom across the cutout 34 in the belt guard 30. The bracket 44 is fashioned with threaded setouts 45 (See FIG. 2) to receive the screws 36. Thus, the position of the stop fingers 42 may be adjusted to limit the upward rotation of the stitch length regulating lever 25 in the forward feed position to that established by service personnel; or, likewise, to limit depression of the stitch length regulating lever in the reverse feed position to the position to which the lower stop finger is set. Screws 36 may be provided having heads thereon which require tools for tightening which are not commonplace. Thus, stitch length settings made by service personnel are not readily defeated by sewing machine operators.

Thus, has been disclosed the means by which stitch length controls may be retrofitted on existing machines by a simple substitution of a modified belt guard thereto. The stops may also be applied at a considerably reduced cost to new machines upon request therefor. Adjustment of the stops is readily performed by loosening screw 36, positioning the stitch length regulating lever 25 to the desired stitch length as indicated by operation of the sewing machine, sliding the stop 40 to have the stop finger 42 abut the stitch length regulating lever 25 and retightening the screw 36 to lock the selected position. The stops 40 are kept in alignment by abutting an angle of the bracket 44. Additional travel for a wide range of stop positions may be accommodated by repositioning screws 36 through the unused aperture 35 in the belt guard 30 and through the threaded setouts 45 by shifting the bracket 44. The stop finger 42 of the stops 40 may be lengthened and contoured as required to extend about the standard 14 to come in engagement with the stitch length regulating lever arm 26 of other configurations of the stitch length regulating lever 25 however situated.

What is claimed is:

1. An industrial sewing machine comprising a frame including a bed supporting a standard at one end thereof, said standard supporting a bracket arm in overhanging relationship to the said bed, said bracket arm terminating in a head, said head supporting therein a needle bar supported for endwise reciprocation, said needle bar terminating in a sewing needle for cooperation with other sewing instrumentalities supported in said bed in the formation of stitches, said frame supporting a handwheel adjacent said standard, said handwheel having a belt groove therein and being operatively connected to said sewing instrumentaltities including said endwise reciprocating needle bar, said head further supporting a presser bar, said presser bar terminating in a presser foot, said bed supporting therein a reversible feed system for cooperation with said presser foot in feeding a work material beneath said sewing needle for the formation of stitches therein, said standard supporting externally thereof means for influencing a variation in stitch length and in stitch direction, said influencing means including a lever supported by said standard, and shiftable to effect a variation in stitch length and stitch direction, a sheet metal belt guard supported adjacent said standard and about said belt groove in said handwheel, and stop means adjustably carried by said sheet metal belt guard and extending in the path of said lever for limiting the extent of travel thereof, said stop means further comprising a stop member having a finger extending into the path of said lever, a slot extending transversely of said finger and through said stop member, and an external surface parallel to said slot; an aperture in said sheet metal belt guard opening to said slot; a screw extending through said aperture and said slot beyond said stop member; and a bracket positioned adjacent said stop member, said bracket having a tapped aperture receiving said screw, and being formed with an angle for receiving said external surface of said stop member, whereby said stop member is retained perpendicular to said slot in a selected position between said sheet metal belt guard and said bracket.

* * * * *